US010449593B2

(12) United States Patent
Breitling et al.

(10) Patent No.: US 10,449,593 B2
(45) Date of Patent: Oct. 22, 2019

(54) WORKPIECE DISCHARGING DEVICES AND RELATED SYSTEMS AND METHODS

(71) Applicant: TRUMPF Werkzeugmaschinen GmbH + Co. KG, Ditzingen (DE)

(72) Inventors: Detlef Breitling, Leonberg (DE); Andreas Bunz, Leinfelden-Echterdingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 815 days.

(21) Appl. No.: 14/812,215

(22) Filed: Jul. 29, 2015

(65) Prior Publication Data

US 2015/0328674 A1 Nov. 19, 2015

Related U.S. Application Data

(62) Division of application No. 13/178,815, filed on Jul. 8, 2011, now Pat. No. 9,126,256.

(30) Foreign Application Priority Data

Jul. 9, 2010 (EP) ..... 10169041

(51) Int. Cl.
*B21D 45/04* (2006.01)
*B21D 43/16* (2006.01)
(Continued)

(52) U.S. Cl.
CPC ..... *B21D 45/04* (2013.01); *B21D 43/16* (2013.01); *B21D 43/28* (2013.01); *B21D 43/282* (2013.01);
(Continued)

(58) Field of Classification Search
CPC .... B12D 37/145; B23Q 3/1556; B21D 28/36; B21D 37/04; B21D 28/12; Y10T 29/49998; B25B 11/00
See application file for complete search history.

(56) References Cited

U.S. PATENT DOCUMENTS 3,815,403 A 6/1974 Daniels
5,247,764 A 9/1993 Jeshurun et al.
(Continued)

FOREIGN PATENT DOCUMENTS

EP 0319821 A2 6/1989
EP 1389596 A1 2/2004
(Continued)

*Primary Examiner* — David P Bryant
*Assistant Examiner* — Nirvana Deonauth
(74) *Attorney, Agent, or Firm* — Fish & Richardson P.C.

(57) ABSTRACT

A machine tool for processing workpieces includes a processing device from which processed products to be discharged can be produced from a workpiece; and a discharge device including a discharge flap that can be pivoted into a discharge position inclined downwards relative to a horizontal position in order to discharge processed products and which defines a discharge direction in the discharge position, the discharge flap comprising a part support disposed along the upper side of the discharge flap along which the processed products move during discharge in the discharge direction, where the part support has at least two support regions which extend in the discharge direction and which are configured to accommodate different types of processed products.

9 Claims, 6 Drawing Sheets

(51) Int. Cl.
*B21D 43/28* (2006.01)
*B21D 45/00* (2006.01)

(52) U.S. Cl.
CPC ..... *B21D 43/287* (2013.01); *B21D 45/00* (2013.01); *B21D 45/003* (2013.01); *Y10T 29/50* (2015.01)

(56) References Cited

U.S. PATENT DOCUMENTS

| | | | | |
|---|---|---|---|---|
| 2009/0010731 | A1* | 1/2009 | Heusel ..... | B21D 45/003 409/199 |
| 2009/0057283 | A1* | 3/2009 | Schmauder ..... | B23K 26/0093 219/121.72 |

FOREIGN PATENT DOCUMENTS

| | | | |
|---|---|---|---|
| GB | 2087286 | A | 5/1982 |
| JP | 7284867 | A | 10/1995 |
| JP | 1076334 | A | 3/1998 |
| JP | 10180474 | A | 7/1998 |
| JP | 201121228 | A | 5/2001 |
| JP | 201129625 | A | 5/2001 |
| JP | 201170727 | A | 6/2001 |
| JP | 2009082928 | A | 4/2009 |
| WO | WO0146044 | A1 | 6/2001 |

* cited by examiner

WORKPIECE DISCHARGING DEVICES AND RELATED SYSTEMS AND METHODS

CROSS-REFERENCE TO RELATED APPLICATION

This application is a divisional of U.S. Ser. No. 13/178,815, filed Jul. 8, 2011, and claims priority under 35 U.S.C. § 119 to European Patent Application No. EP 10 169 041.0, filed on Jul. 9, 2010. The contents of these priority applications are hereby incorporated by reference in their entirety.

TECHNICAL FIELD

This invention relates to workpiece discharging devices and related systems and methods.

BACKGROUND

Japanese Patent Application No. JP 10-180474A discloses a punching machine, in which processing products are removed from the processing area of a punching tool by a pivotable discharge flap. The discharge flap has a support brush having a plurality of bundles of bristles acting as a part support. The bristles of each bristle bundle are surrounded by a shaft-like holder at the ends thereof remote from the processing products to be discharged. The shaft-like holders are themselves arranged for pivoting about a horizontal axis. A pivoting mechanism which acts on the shaft-like holders of the bristle bundles ensures that the shaft-like holders and the bristle bundles of the support brush therewith are pivoted in a discharge direction about the horizontal axis of the shaft-like holders as soon as the discharge flap pivots downwards into the discharge position from the horizontal. The processed products to be discharged move on the inclined bristle bundles in a discharge direction. The inclination of the bristle bundles on the discharge flap is intended to ensure that the relevant processing products are discharged in a process-reliable manner.

SUMMARY

In one aspect of the invention, a discharge device for discharging a processed product in a machine tool for processing workpieces (e.g., metal sheets) includes a discharge flap configured to be pivoted to a discharge position inclined downwards relative to a horizontal position in order to discharge the processed product in a discharge direction, a part support arranged along an upper surface of the discharge flap along which the processed product moves during discharge in the discharge direction.

In some aspects of the invention, a machine tool for processing workpieces (e.g., metal sheets) includes a processing device by which products can be produced from a workpiece and a discharge device as discussed above.

In some aspects of the invention, a method for processing workpieces (e.g., metal sheets) includes positioning a workpiece relative to a processing device to undergo a workpiece processing operation and arranging a processed product resulting from the workpiece processing operation on a support region of a part support of a discharge device when the workpiece processing operation is finished.

In some aspects of the invention, a computer program product can be used to carry out the steps of the method for processing workpieces (e.g., metal sheets) includes discharging processed products produced by the workpiece processing operation in a machine tool.

In some aspects of the invention, a part support at a discharge flap of a discharge device includes support regions which are, in terms of their properties, adapted to the relevant different product types of processed products. Processed products may be of different types, for example, in terms of their size, mass, and/or surface properties (e.g., scratch-resistance). By the processed products and the support regions of the part support being correspondingly associated with each other, different types of processed products can be discharged in a manner which accounts for special characteristics of the products. A high level of process reliability is associated with some aspects of the invention in a number of regards. Since optimization of the discharge operation is achieved by the part support at the discharge flap being specially constructed, supplementary devices which would be not only structurally complex but also susceptible to failure may be omitted. Furthermore, for the support regions of the part support, there are selected properties which help to ensure that the processed products are actually discharged and do not remain on the discharge flap and then impede subsequent processing operations in the machine tool. The processing device of the machine tool may be integrated in the part support and/or be connected to the discharge flap. Finally, a high level of process reliability can be ensured in that the support regions of the part support of discharge devices can be adapted in terms of the properties thereof to the wear characteristics both of the part support itself and of the processed products to be conveyed away or discharged. For example, support regions having high abrasion resistance serve to discharge abrasive processed products. Similarly, support regions which protect the processed products during the discharge operation can be provided for processed products having sensitive surfaces. In some aspects of the invention, a computer program product serves to automate the machines and methods used to discharge processed workpieces from machine tools.

There are a number of possibilities for adapting the support regions of the part support to discharge different types of processed products. In some embodiments, different support regions can be produced from different materials and/or from surfaces having different surface properties. For example, combining support regions of plastic materials and support regions of metal is possible.

Additionally or alternatively, the support regions of the part support can be formed by support elements of different construction types or support elements of the same construction type but with different discharge characteristics for adaptation to different types of processed products. In some embodiments, support elements of different construction types are, for example, support brushes, support balls, and/or support rollers. For instance, support brushes whose bristles or bristle bundles are produced from different plastics materials may be used as support elements of the same construction type but with different discharge characteristics.

In some embodiments, the adaptation of the support regions of the part support to different types of processed products is carried out in that support elements of the support regions are arranged so as to be distributed over the support regions with different patterns. For example, the support elements of one of the support regions can be arranged in rows which extend in the discharge direction and which are spaced apart from each other transversely relative to the discharge direction. If processed products have formations at the lower side thereof and if the mutual spacing of the rows of support elements is greater than the corresponding extent of the formation, the formation can be introduced into the intermediate space between mutually adjacent support element rows. During its discharge movement, the relevant processed product is guided by the formation and the support element rows adjacent thereto, and the formation is prevented from becoming hooked on the support elements, which would impede the discharge operation. Processed products having a planar lower surface can also be conveyed away by means of support regions of the part support whose support elements are arranged in a pattern which is different from a pattern of rows.

In some embodiments, at least one of the support regions of the part support is adapted to different types of processed products to be in the form of a support brush having support elements in the form of bristles and/or bristle bundles. Support brushes have been found to be advantageous in practice in a large number of applications. They offer diverse possibilities for adaptation to the processed products to be discharged.

In some embodiments, multiple support brushes are provided, and each of the support brushes is adapted to a specific type of processed product. Adaptation to the different types of processed products can be carried out by the properties of the bristles and/or the bristle bundles of the support brushes being selected.

In some embodiments, the bristles and/or the bristle bundles of the support brushes adapted to different types of processed products are produced from different materials and/or have different rigidity and/or hardness and/or have a different inclination relative to the discharge direction. For instance, in order to carry away processed products which are heavy and, at the same time, wear-resistant, it is advantageous to use bristles and/or bristle bundles having relatively great rigidity or hardness. In that application, soft bristles and bristle bundles would be subjected to enormous wear and could consequently only achieve short service-lives. Soft bristles and bristle bundles can instead be used to discharge processed products which are lighter and consequently less abrasive. The inclination of the bristles and bristle bundles of the support brushes relative to the discharge direction may vary within broad limits. It is possible to have an orientation of the bristles and bristle bundles which is perpendicular to the discharge direction but also an inclination toward or away from the discharge direction.

The vertical displacement of support regions of the part support, in some embodiments, can ensure a permanent association of the processed products with the relevant support region. Processed products which are associated with the support region located in a lower position cannot reach the support region at the higher position during the discharge movement due to the vertical displacement. Processed products which are associated with the higher discharge region do not come into contact with the lower support region even if they move during the discharge movement laterally in a limited manner in the direction towards the lower support region. As long as the majority of the relevant processed products remain on the higher support region, the processed products may partially protrude laterally beyond the higher support region, but the processed products do not come to rest on the lower support region.

In some embodiments, processed products of a corresponding size can be supported at both sides of the central support region on the two outer, higher support regions without coming into contact with the central lower support region. This is advantageous in cases in which workpieces to be processed, typically metal sheets, have to be positioned relative to a processing device for processing purposes and move during the positioning movements also over the part support of the horizontally orientated discharge flap. During the positioning movements relating to processing, the workpiece to be processed is supported on the outer support regions whose properties (e.g., rigidity and wear resistance) are configured in accordance with the loads associated with positioning movements of the type mentioned. Independently, the central support region used only for discharge purposes can be constructed in such a manner that allows for optimum discharge of processed products.

In some embodiments, the machine tool includes a positioning device to ensure functionally reliable association of the processed products with the support regions of the part support associated therewith.

In some embodiments, the device which positions workpieces to be processed relative to the processing device is used as the positioning device. In the case of machine tools for processing sheet metal, a coordinate guide of conventional construction type can be used as the positioning device.

Typically, in cases in which relatively small processed products are produced, such processed products can be supported only by the processing device after the workpieces have been processed and must then be transferred by the processing device to the associated support region of the part support. That transfer can be brought about readily and in a functionally reliable manner if the relevant support region of the part support is aligned with the workpiece support in the processing device or is arranged below that workpiece support. Under those circumstances, the processed products do not have to be moved over a step which would be produced if the relevant support region of the part support were to protrude upwards relative to the workpiece support in the processing device.

The devices, systems, and methods described herein can be used to increase the process reliability of the discharge of processing products in machine tools over conventional systems.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
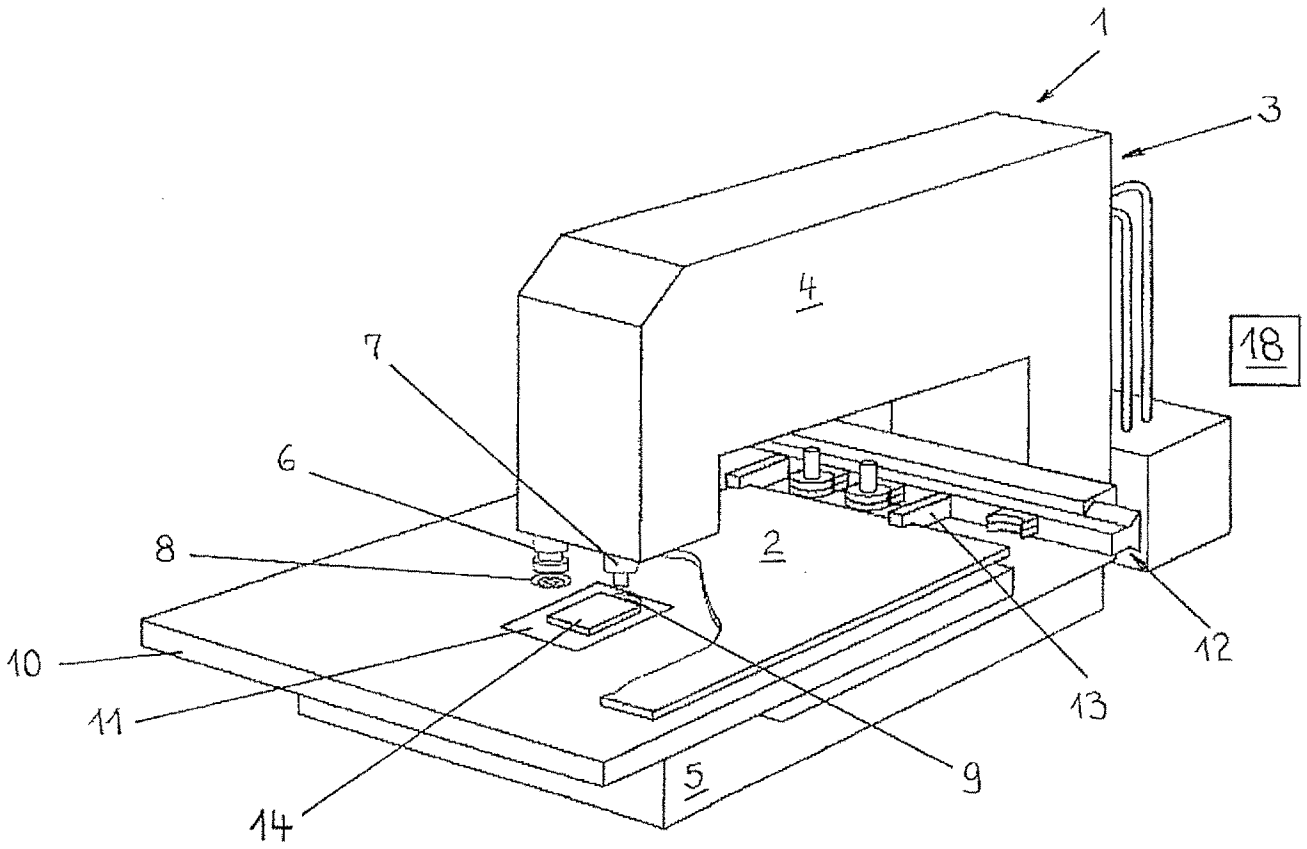
FIG. 1 is a schematic view of a machine tool for processing sheet metal provided with a discharge device that includes a discharge flap.

As shown in FIG. 1, a machine tool 1 for processing metal sheets 2 has a C-shaped machine frame 3 having an upper frame leg 4 and a lower frame leg 5. The machine tool 1 is in the form of a combination machine and allows sheet metal both to be processed by punching and to be processed by laser. Therefore, a punch head 6 and a laser cutting head 7 are provided as processing devices at the free end of the upper frame leg 4.

A punch die 8 acting as the lower tool is associated with the punch head 6 and a laser die 9 is arranged opposite the laser cutting head 7 as the associated processing device. The punch die 8 is provided on a fixed machine table 10. The laser die 9 is arranged on a discharge flap 11 which is itself embedded in the machine table 10.

Both the machine table 10 and the discharge flap 11 have a workpiece support at their upper sides. The workpiece support generally supports the sheet metal 2 while the sheet metal 2 is moved for processing purposes. Two-axis horizontal sheet metal movements are produced by a coordinate guide 12 of conventional construction type, with which the metal sheet 2 to be processed is fixed by means of clamping lugs 13.

The workpiece support of the discharge flap 11 also supports, in addition to the metal sheet 2 moved for processing purposes, processed products which are produced when the sheet metal is processed and which are intended to be discharged from the vicinity of the laser cutting head 7 after production. Such a processed product 14 is illustrated in FIG. 1 in the form of a finished part which has been cut out of the sheet metal 2 by the laser cutting head 7 and the laser die 9.

Figure 2:
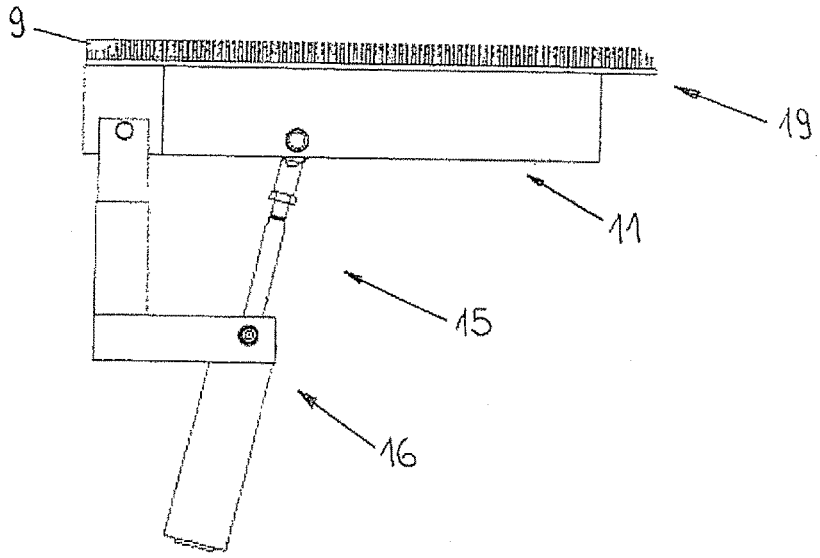
FIG. 2 is a side view of the discharge device for the machine tool of FIG. 1 in the closed position.
Figure 3:
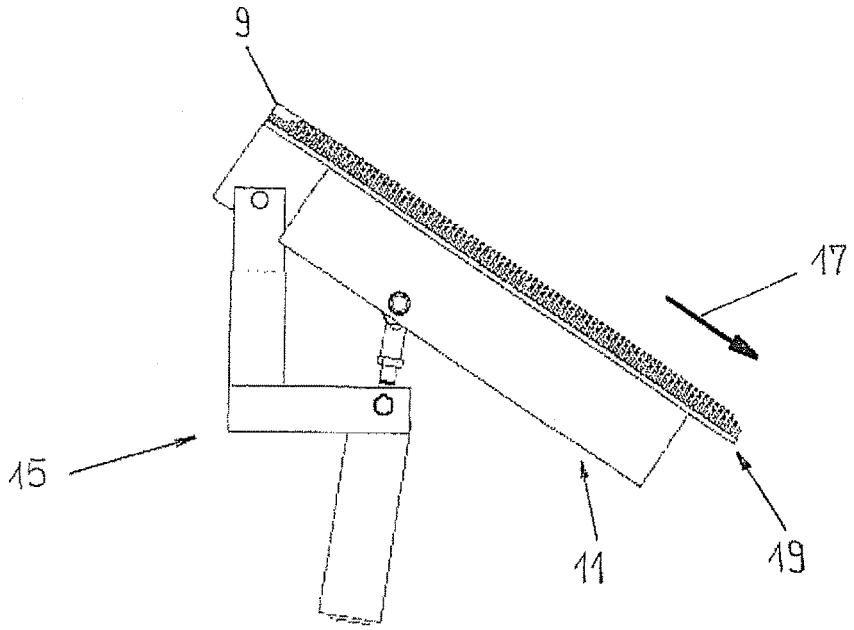
FIG. 3 is a side view of the discharge device of FIG. 2 in the discharge position.

The discharge flap 11 is part of a discharge device 15 (FIGS. 2 and 3). In addition to the discharge flap 11, the discharge device 15 includes a pivot drive 16 in the form of a piston/cylinder unit which serves to pivot the discharge flap 11 back and forth between a horizontal position (shown in FIG. 2) and a discharge position (shown in FIG. 3). In the discharge position, the discharge flap 11 is inclined downwards relative to the horizontal position and thereby defines a discharge direction 17, in which the processed products 14 move during discharge under the action of gravitational force. Similar to the remaining structural units of the machine tool 1, the discharge device 15 is also numerically controlled. A programmable CNC control 18 is provided for that purpose.

Various embodiments are possible for the discharge flap 11. The individual construction types of the discharge flap 11 differ in terms of the construction of a part support, on which the processed products move during discharge in the discharge direction 17. Typically, the part supports have multiple different support regions which extend in the discharge direction 17 and which are, in terms of their properties, adapted to different types of processed products 14.

Figure 4:
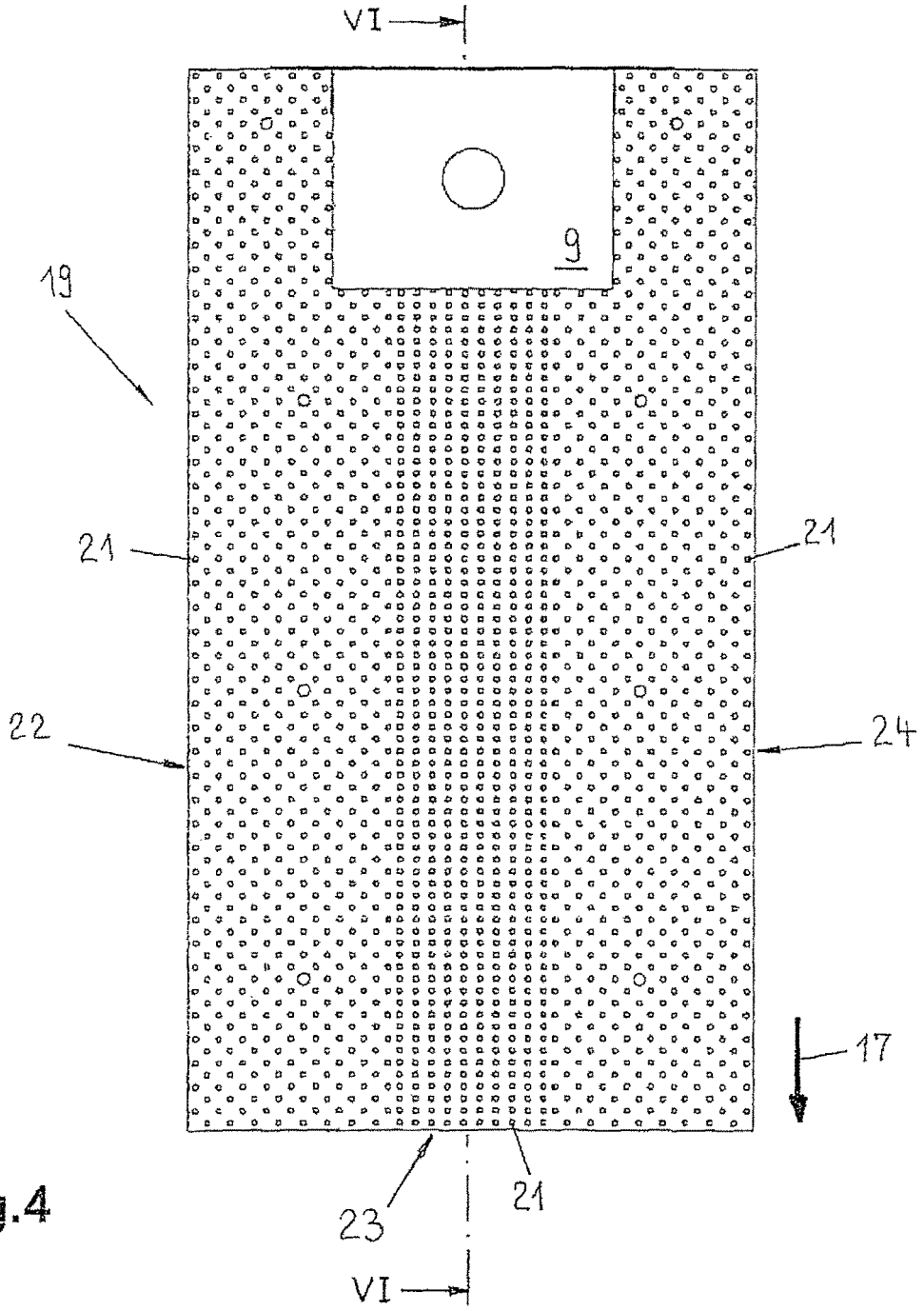
FIG. 4 is a top view of the discharge flap of the discharge device of FIGS. 2 and 3.
Figure 5:
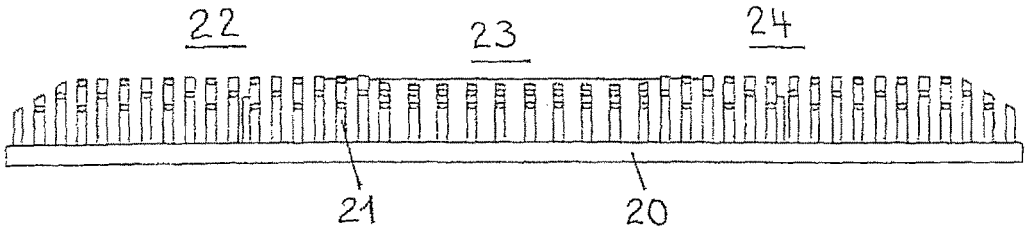
FIG. 5 is a front view of a part support of the discharge flap of FIGS. 2 through 4.
Figure 6:
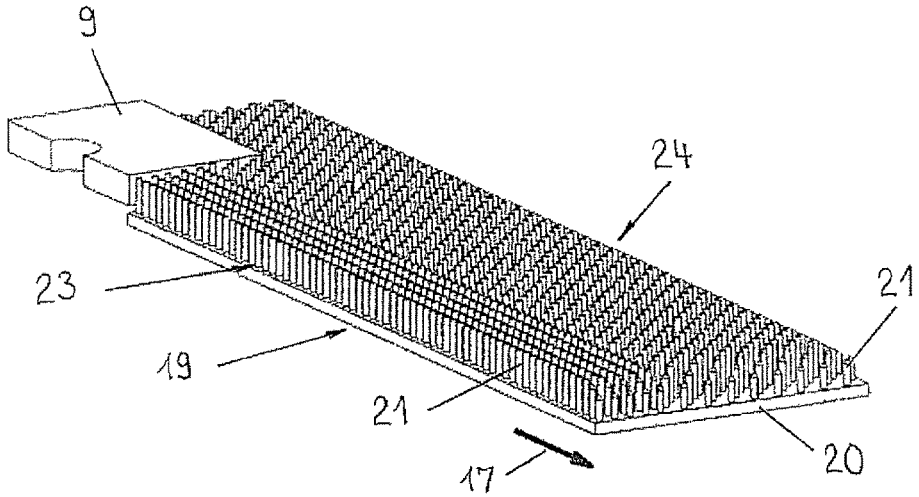
FIG. 6 is a sectional, perspective view of a part support of the discharge flap of FIGS. 2 to 5, with a plane of section which extends along the line VI-VI in FIG. 4.

A part support 19 is shown in FIGS. 2 and 3 as a component of the discharge flap 11 and is shown in FIGS. 4 through 6 as an individual component not connected to a discharge flap 11.

As shown in FIG. 5, the part support 19 has a base plate 20 on which a large number of support elements in the form of bristle bundles 21 are anchored.

The part support 19 includes three support regions 22, 23, 24 which are arranged beside each other transversely to the discharge direction 17. The two outer support regions 22, 24 are positioned to the sides of the central support region 23 and protrude toward the processed products 14. Each of the support regions 22, 23, 24 is in the form of a support brush. The support regions 22, 24 are configured to support certain types of processed products, while the support region 23 is adapted to support other types of processed products 14.

A number of measures are taken in the design of the support regions 22, 23, 24 of the part support 19 for adapting them to support different types of processed products 14.

Firstly, the bristle bundles 21 of the outer support regions 22, 24 are arranged in a pattern different from that of the bristle bundles 21 of the central support region 23. Although the bristle bundles 21 of all support regions 22, 23, 24 are arranged in rows which extend in the discharge direction 17, unlike in the central support region 23, mutually adjacent bristle bundle rows of the outer support regions 22, 24 are displaced relative to each other in the discharge direction 17 by half the spacing of two bristle bundles. As shown in FIG. 4, this results in a square arrangement of the bristle bundles 21 in the central support region 23 that is aligned with the discharge direction 17 and a square arrangement of the bristle bundles 21 in the outer support regions 22, 24 that includes larger squares that are arranged approximately 45° from the discharge direction 17. Since the intermediate spaces between the bristle bundle rows of the central support region 23 extend continuously in the discharge direction 17, the central support region 23 is particularly suitable for discharging processed products 14 which have a projection (e.g., a formation) along the lower side of the processed product 14 directed towards the part support 19. Such a projection having corresponding dimensions may arrange itself in the intermediate space between two mutually adjacent bristle bundle rows and then move without obstruction in the discharge direction 17 during the discharge movement of the relevant processed product 14. Consequently, the discharge movement of the processed product 14 is not obstructed by the projection at the lower side thereof.

Another measure for adaptation to different types of processed products 14 involves sizing of the outer support regions 22, 24 and the central support region 23. Due to its smaller width, the support region 23 is typically used to discharge processed products 14 which have smaller dimensions than the processed products 14 which are associated with the outer support regions 22, 24.

Finally, adaptation to different types of processed products is also carried out by the properties of the bristle bundles 21 of the support regions 22, 24 and the bristle bundles 21 of the support region 23. Since the central support region 23 is reserved for relatively small and consequently also relatively light processed products 14 whereas the outer support regions 22, 24 typically support relatively large and consequently relatively heavy processed products 14, the bristle bundles 21 of the central support region 23 have a lower level of rigidity or hardness than the bristle bundles 21 of the outer support regions 22, 24. Due to the softness of its bristle bundles 21, the central support region 23 is also particularly suitable for discharging processed products 14 having sensitive surfaces. The outer support regions 22, 24 can also readily support a metal sheet 2 during processing due to the hardness of the bristle bundles 21 and the associated wear resistance. Due to the vertical displacement of the outer support regions 22, 24 relative to the central support region 23, a metal sheet 2 moved over the outer support regions 22, 24 does not come into contact with the central support region 23 and bring about undesirable wear of the central support region 23. The different rigidity or hardness of the bristle bundles 21 may be brought about by forming the bristle bundles 21 of the outer support regions 22, 24 of thicker individual bristles than the bristle bundles 21 of the central support region 23. It is also possible to produce the bristle bundles 21 of the central support region 23 from softer plastics materials than the bristle bundles 21 of the outer support regions 22, 24 or to vary the number of individual bristles per bristle bundle 21 in accordance with the desired rigidity or hardness.

Figure 7:
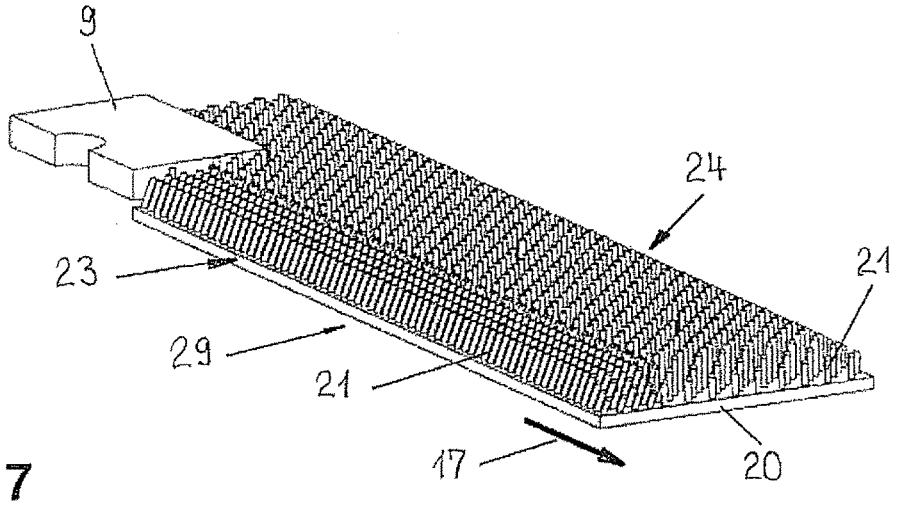
FIG. 7 is a sectional, perspective view of another example of a part support of a discharge flap.
Figure 8:
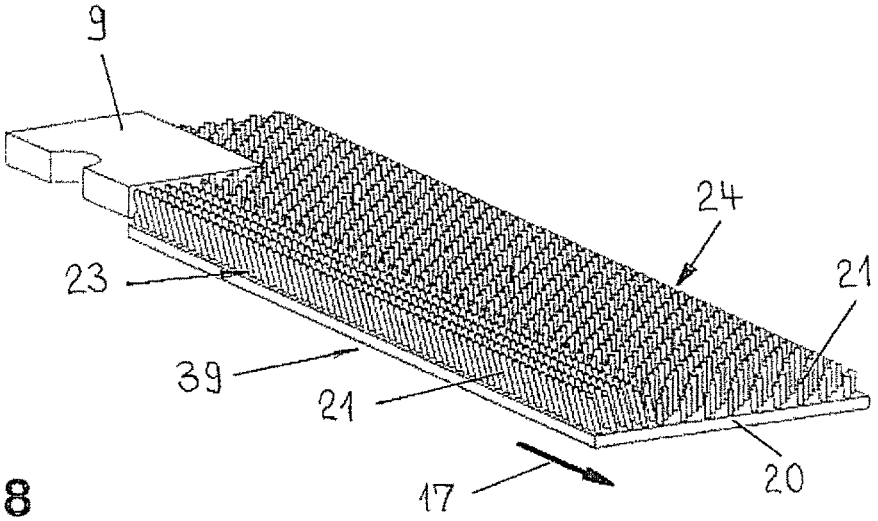
FIG. 8 is a sectional, perspective view of another example of a part support of a discharge flap.

As shown in FIG. 6, the bristle bundles 21 of all the support regions 22, 23, 24 extend on the part support 19 perpendicularly to the discharge direction 17. In that regard, a part support 29 shown in FIG. 7 and a part support 39 shown in FIG. 8 differ from the part support 19 shown in FIG. 6. The bristle bundles 21 of the central support region 23 are inclined toward the discharge direction 17 in the part support 29 shown in FIG. 7 and are inclined away from the discharge direction 17 in the part support 39 shown in FIG. 8. The bristle bundles 21 of the outer support regions 22, 24 in FIGS. 6-8 extend perpendicularly to the discharge direction 17. Both in the case of inclination of the bristle bundles 21 in the discharge direction 17 and in the case of inclination of the bristle bundles 21 in the opposite direction, a smaller movement resistance is imposed on the processed product 14 to be discharged than in an orientation of the bristle bundles 21 that is perpendicular to the discharge direction 17. Consequently, the central support regions 23 of the part supports 29, 39 are typically used for discharging light processed products 14 whereas the outer support regions 22, 24 of the part supports 29, 39 are typically used for discharging heavy processed products 14.

Figure 9:
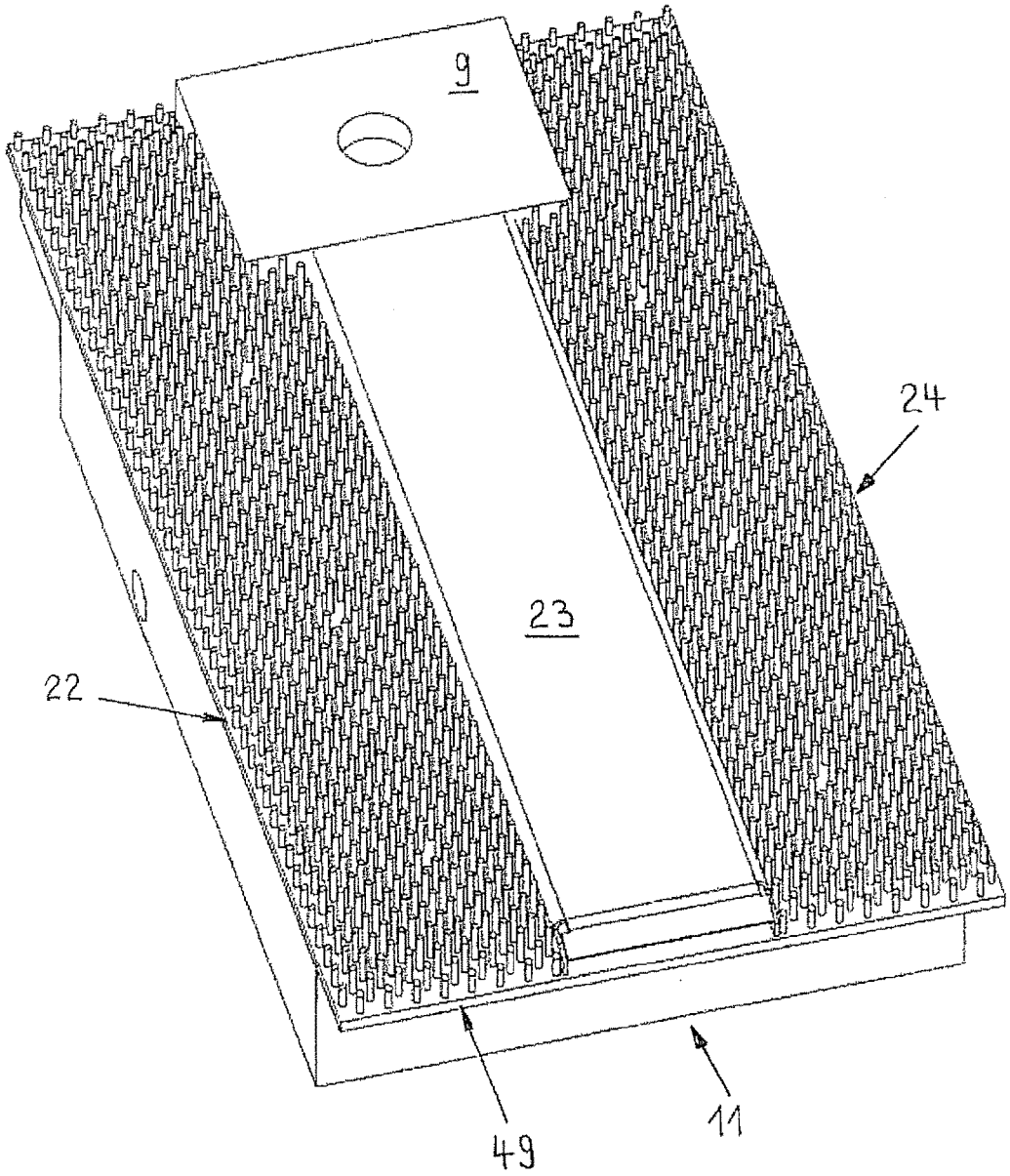
FIG. 9 shows another example of a discharge flap.

FIG. 9 shows a part support 49 whose support regions 22, 23, 24 are produced from different materials for adaptation to different types of processed products 14. As in the case of the part supports 19, 29, 39, the outer support regions 22, 24 are constructed as support brushes in the part support 49. Unlike the above-described construction types, however, a support plate is provided in the part support 49 as a central support region 23. The support plate of the central support region 23 of the part support 49 is also lowered relative to the outer support regions 22, 24. Due to its smooth surface, the support plate of the part support 49 provides only a small movement resistance to processed products 14 which move on the support plate in the discharge direction 17. Therefore, the central support region 23 of the part support 49 can be used for discharging light and/or small processed products 14.

Irrespective of the construction type of the part support used, the laser die 9 acting as a processing device for processing sheet metal is fitted to the discharge flap 11. Consequently, the laser die 9 is pivoted together with the discharge flap 11.

When a metal sheet workpiece 2 is processed, the metal sheet 2 is positioned relative to the laser die 9 by the coordinate guide 12 acting as a positioning device in such a manner that the processed product 14 produced during the sheet metal processing operation comes to rest on the support region 22, 23, 24 of the part support 19, 29, 39, 49 provided to discharge the relevant processed product 14 after the discharge flap 11 has been pivoted into the discharge position. If processed products 14 having small dimensions are produced during the sheet metal processing operation, they are supported only on the upper side of the laser die 9 which acts as a support for processed products 14 after the sheet metal processing operation has been finished. In order to ensure that such processed products 14 having small dimensions reach the central support region 23 provided for discharging small parts after the discharge flap 11 has been pivoted into the discharge position, the upper side of the laser die 9 is slightly raised relative to the support region 23 of the part supports 19, 29, 39, 49. Consequently, the processed products 14 having small dimensions do not have to overcome a step, which could obstruct a discharge movement, during their movement in the discharge direction 17 between the laser die 9 and the support region 23. Alternatively, the upper side of the laser die 9 can be aligned with the upper side of the support region 23.

As discussed above, the workpiece discharging devices and related systems described herein can include a computer product having a code (or algorithm) which can be adjusted for performing the steps of the above-described workpiece processing and discharging methods.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially generated propagated signal, for example, a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (for example, multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, for example, an FPGA (field programmable gate array) or an ASIC (application specific integrated circuit). The apparatus can also include, in addition to hardware, code that creates an execution environment for the computer program in question, for example, code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (for example, one or more scripts stored in a markup language document), in a single file dedicated to the program in question, or in multiple coordinated files (for example, files that store one or more modules, sub programs, or portions of code). A computer program can be deployed to be executed on one computer or on multiple computers that are located at one site or distributed across multiple sites and interconnected by a communication network.

The processes described in this specification can be performed by one or more programmable processors executing one or more computer programs to perform actions by operating on input data and generating output. The processes can also be performed by, and apparatus can also be implemented as, special purpose logic circuitry, for example, an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, for example, magnetic, magneto optical disks, or optical disks. However, a computer need not have such devices. Moreover, a computer can be embedded in another device, for example, a mobile telephone, a personal digital assistant (PDA), a mobile audio or video player, a game console, a Global Positioning System (GPS) receiver, or a portable storage device (for example, a universal serial bus (USB) flash drive), to name just a few. Devices suitable for storing computer program instructions and data include all forms of nonvolatile memory, media and memory devices, including by way of example semiconductor memory devices, for example, EPROM, EEPROM, and flash memory devices; magnetic disks, for example, internal hard disks or removable disks; magneto optical disks; and CD ROM and DVD-ROM disks. The processor and the memory can be supplemented by, or incorporated in, special purpose logic circuitry.

A number of embodiments of the invention have been described. Nevertheless, it will be understood that various modifications may be made without departing from the spirit and scope of the invention. Accordingly, other embodiments are within the scope of the following claims.

What is claimed is:

1. A workpiece processing method, comprising:

positioning a workpiece relative to a processing device to undergo a workpiece processing operation;

producing a processed product as a result of the workpiece processing operation, the processed product being of a first type or of a second type that is different from the first type; and discharging the processed product using a discharge device that comprises a discharge flap, the discharge flap being pivotal into a discharge position inclined downward relative to a horizontal position and defining a discharge direction, and the discharge flap comprising a part support on an upper side thereof, wherein the part support comprises first and second support regions that extend in the discharge direction;

wherein the first support region comprises first properties configured to support the processed product being of the first type such that the first support region is configured to move the processed product being of the first type in the discharge direction;

wherein the second support region comprises second properties that are different from the first properties of the first support region and that are configured to support the processed product being of the second type such that the second support region is configured to move the processed product being of the second type in the discharge direction;

wherein the workpiece, undergoing the workpiece processing operation, is positioned in a manner such that:

the processed product being of the first type resulting from the workpiece processing operation is arranged on the first support region when the workpiece processing operation is finished, or the processed product being of the second type resulting from the workpiece processing operation is arranged on the second support region when the workpiece processing operation is finished; and wherein the first support region is constructed of a support brush comprising one or both of first bristles and first bristle bundles and the second support region is constructed of a support brush comprising one or both of second bristles and second bristle bundles, the one or both of the first bristles and the first bristle bundles having a different angle of orientation with respect to the discharge direction than the one or both of the second bristles and the second bristle bundles.

2. The workpiece processing method according to claim 1, wherein the first support region has different surface properties than the second support region.

3. The workpiece processing method according to claim 1, wherein one of the first and second support regions protrudes towards the processed product to a greater extent than the other of the first and second support regions.

4. The workpiece processing method according to claim 1, wherein the one or both of the first bristles and the first bristle bundles further have one or more of a different material type, a different rigidity, and a different hardness than the one or both of the second bristles and the second bristle bundles.

5. The workpiece processing method according to claim 1, wherein the first support region has a different material composition than the second support region.

6. The workpiece processing method according to claim 1, wherein the first and second support regions comprise support elements, at least one support element of the first support region having a different construction type than at least one support element of the second support region.

7. The workpiece processing method according to claim 1, wherein the first and second support regions comprise support elements, the support elements of the first support region being arranged in a first pattern along the first support region and the support elements of the second support region being arranged in a second pattern along the second support region, and the first pattern being different than the second pattern.

8. The workpiece processing method according to claim 1, wherein the part support further comprises a third support region, wherein the second support region is arranged between the first support region and the third support region in a direction transverse to the discharge direction, and the first support region and the third support region project towards the processed product to a greater extent than the second support region.

9. A workpiece processing method, comprising:

positioning a workpiece relative to a processing device to undergo a workpiece processing operation;

producing a processed product as a result of the workpiece processing operation, the processed product being of a first type or of a second type that is different from the first type; and discharging the processed product using a discharge device that comprises a discharge flap, the discharge flap being pivotal into a discharge position inclined downward relative to a horizontal position and defining a discharge direction, and the discharge flap comprising a part support on an upper side thereof, wherein the processing device is fitted to the discharge flap, wherein the part support comprises first and second support regions that extend in the discharge direction;

wherein the first support region comprises first properties configured to support the processed product being of the first type such that the first support region is configured to move the processed product being of the first type in the discharge direction;

wherein the second support region comprises second properties that are different from the first properties of the first support region and that are configured to support the processed product being of the second type such that the second support region is configured to move the processed product being of the second type in the discharge direction;

wherein the workpiece, undergoing the workpiece processing operation, is positioned in a manner such that:

the processed product being of the first type resulting from the workpiece processing operation is arranged on an upper side of the processing device when the workpiece processing operation is finished, such that the processed product being of the first type is transferred from the upper side of the processing device to the first support region after the discharge flap has been pivoted into the discharge position, or the processed product being of the second type resulting from the workpiece processing operation is arranged on the upper side of the processing device when the workpiece processing operation is finished, such that the processed product being of the second type is transferred from the upper side of the processing device to the second support region after the discharge flap has been pivoted into the discharge position; and wherein the first support region is constructed of a support brush comprising one or both of first bristles and first bristle bundles and the second support region is constructed of a support brush comprising one or both of second bristles and second bristle bundles, the one or both of the first bristles and the first bristle bundles having a different angle of orientation with respect to the discharge direction than the one or both of the second bristles and the second bristle bundles.

* * * * *